US008495985B2

(12) United States Patent
Harada et al.

(10) Patent No.: US 8,495,985 B2
(45) Date of Patent: Jul. 30, 2013

(54) FUEL DELIVERY PIPE WITH DAMPER FUNCTION

(75) Inventors: Naruki Harada, Nagoya (JP); Daigo Kawamura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 336 days.

(21) Appl. No.: 12/887,848

(22) Filed: Sep. 22, 2010

(65) Prior Publication Data

US 2011/0197856 A1 Aug. 18, 2011

(30) Foreign Application Priority Data

Sep. 25, 2009 (JP) ..... 2009-221253

(51) Int. Cl.
*F02M 55/02* (2006.01)

(52) U.S. Cl.
USPC ..... 123/456; 123/446; 123/447; 123/457; 123/465

(58) Field of Classification Search
USPC ..... 123/446, 447, 456, 457, 465, 467–469; 138/26–30
See application file for complete search history.

(56) References Cited

U.S. PATENT DOCUMENTS

| | | | | |
|---|---|---|---|---|
| 6,109,304 | A * | 8/2000 | Wolf et al. | 138/30 |
| 7,028,668 | B1 * | 4/2006 | West et al. | 123/456 |
| 2002/0043249 | A1 * | 4/2002 | Lee et al. | 123/456 |
| 2007/0169754 | A1 * | 7/2007 | Usui et al. | 123/468 |
| 2008/0142105 | A1 * | 6/2008 | Zdroik et al. | 138/30 |

FOREIGN PATENT DOCUMENTS

| | | | |
|---|---|---|---|
| JP | B2-3217775 | | 10/2001 |
| JP | 2002061552 | * | 2/2002 |
| JP | B2-4230100 | | 2/2009 |

* cited by examiner

*Primary Examiner* — Stephen K Cronin
*Assistant Examiner* — Joseph Dallo
(74) *Attorney, Agent, or Firm* — Oliff & Berridge, PLC

(57) ABSTRACT

A fuel delivery pipe with damper function, being constructed of an elongate lower case provided at its bottom with a plurality of injection sockets for connection with fuel injection valves to be opened and closed by a controller unit; an upper case coupled with the lower case in a liquid-tight manner to form an internal space to be filled with fuel under pressure supplied from a fuel pump; a hollow partition wall member the whole periphery of which is brazed to an inner surface of the lower or upper case to form an air chamber isolated from the internal space; and a vent hole formed in the lower or upper case and sealed after communicating the air chamber with the atmosphere therethrough.

6 Claims, 4 Drawing Sheets

FUEL DELIVERY PIPE WITH DAMPER FUNCTION

BACKGROUND OF THE INVENTION

1. Field of the Invention

The present invention relates to a fuel delivery pipe with damper function adapted for use in an engine of the electronically controlled fuel injection type and a manufacturing method of the same.

2. Discussion of the Prior Art

Disclosed in Japanese Patent Publication No. 4230100 is a conventional fuel delivery pipe of this kind which is constructed of lower and upper cases integrally jointed by brazing, the lower case being provided at its bottom with a plurality of injection sockets spaced in a longitudinal direction for connection with fuel injection valves, and the upper case being in the form of a double walled structure the interior of which is subdivided into air chambers by means of a box-shaped wall panel in an air-tight manner. In the fuel delivery pipe, the air trapped in the air chambers is expanded and contracted by heating and cooling of the brazed wall panel, resulting in deformation of the wall panel. This causes difference in damper function of pressure pulsations of each fuel delivery pipe. To solve the problem, an air hole is provided in the upper case for communication with the atmosphere and is closed by a cap member after brazing process of the lower and upper cases. In a fuel delivery pipe disclosed in Japanese Patent No. 3217775, a damper member in the form of a metallic pipe of flat-circular in cross-section sealed at its opposite ends to contain therein gas is assembled within a case body of the fuel delivery pipe. The damper member is brazed at its opposite ends to the case body and is sealed at its one end after brazed by means of a seal plug attached from the exterior of the case body.

As in the fuel delivery pipes described above, the cap member or the seal plug is needed to close the air chamber in communication with the atmosphere, the number of component parts increases, resulting in difficulty of reduction of the manufacturing cost. As the head of the cap member projects from the fuel delivery pipe, a space for mounting the delivery pipe increases. In addition, the capacity for absorbing fluctuation of fuel pressure is restricted by the wall panel provided in the upper case.

SUMMARY OF THE INVENTION

To solve the foregoing problems, an object of the present invention is directed to provide a fuel delivery pipe with damper function, comprising: an elongate lower case provided at its bottom with a plurality of injection sockets for connection with fuel injection valves to be opened and closed under control of a controller unit; an upper case coupled with the lower case in a liquid-tight manner to form an internal space to be filled with fuel under pressure supplied from a fuel pump; a hollow partition wall member the whole periphery of which is fixed to an inner surface of the lower or upper case to form an air chamber isolated from the internal space; and a vent hole formed in the lower or upper case and sealed after communicating the air chamber with the atmosphere therethrough; wherein the partition wall member is flexible in accordance with pressure pulsations of fuel in the internal space caused by open-and-close operation of the injection valves to fluctuate the capacity of the air chamber in the internal space thereby to damp the pressure pulsations and to reduce disorder of the injection amount of fuel, and wherein the vent hole is in the form of a cylindrical hole formed by cutting or punching to be smaller in diameter than the thickness of the lower or upper case and sealed by the mother metal of the lower or upper case or a filler metal melted by local heating at its outer periphery and hardened by cooling.

In a practical embodiment of the present invention, it is preferable that the vent hole is in the form of a burring hole formed by pushing a punch pointed at its tip into the bottom wall of the lower case or the peripheral wall of the upper case. It is also preferable that the hollow partition wall member is constructed of an elongate top wall, a peripheral wall downward from the whole periphery of the top wall and a lateral flange extended outward from the lower end of the peripheral wall, wherein the lateral flange of partition wall member is fixed to a flat portion of the lower or upper case in a liquid-tight manner to form the air chamber.

In another practical embodiment of the present invention, it is preferable that the height of the peripheral wall of the partition wall member is formed larger than the width of the top wall so that opposed portions of the peripheral wall are flexible to fluctuate the capacity of the air chamber thereby to absorb pressure pulsations of fuel in the internal space for reducing disorder of the injection amount of fuel. It is also preferable that at least one of injection sockets is arranged at a one-sided position in a width direction across the longitudinal direction of the bottom wall, wherein the partition wall member is placed at an opposite-sided position in the width direction to occupy a greater part of the bottom wall of the lower case.

In a practical embodiment of the present invention, it is preferable that the injection sockets each are comprised of a separately formed cylindrical body for connection with the respective injection valves and a cylindrical projection smaller in diameter than the cylindrical body, wherein the cylindrical projection is positioned in engagement with a mounting hole of the lower case such that the interior of the cylindrical body is in open communication with the internal space. Furthermore, it is preferable that the hollow partition wall member is divided into a plurality of hollow partition wall members which are arranged among the injection sockets and brazed on the bottom wall of the lower case, wherein the bottom wall of the lower case is formed with a plurality of vent holes which are sealed after communicating each interior of the partition wall members with the atmosphere.

In a practical embodiment of the present invention, there is provided a fuel delivery pipe with damper function, comprising an elongate lower case provided at its bottom with a plurality of sockets for connection with fuel injection valves to be opened and closed under control of a controller unit; an upper case coupled with the lower case in a liquid-tight manner to form an internal space to be filled with fuel under pressure supplied from a fuel pump; a cylindrical partition wall member having at least one end fixed to an inner surface of the lower case or upper case to form an air chamber isolated from the internal space; and a vent hole formed in the lower case or upper case at a position for connection with the one end of the partition member to be sealed after communicating the air chamber with the atmosphere; wherein the partition wall member is flexible in accordance with pressure pulsations of fuel in the internal space caused by open-and-close operation of the injection valves to fluctuate the capacity of the air chamber in the internal space thereby to damp the pressure pulsations of fuel and to reduce disorder of the injection amount of fuel, and wherein the vent hole is in the form of a cylindrical hole formed by cutting or punching to be smaller in diameter than the thickness of the lower or upper case and sealed by the mother metal of the lower or upper case or a filler metal melted by local heating at its outer periphery and hardened by cooling. In this embodiment, it is preferable that the vent hole is in the form of a burring hole formed by pushing a punch pointed at its tip into the lower or upper case.

In the fuel delivery pipe described above, it is preferable that the upper case is formed with an inwardly bent portion along a longitudinal direction which is displaced in its thickness direction to fluctuate the capacity of the internal space in accordance with pressure pulsations of fuel caused by open-and-close operation of the injection valves thereby to absorb the pressure pulsations of fuel and to reduce disorder of the injection amount of fuel.

In a manufacturing process of the fuel delivery pipe, it is preferable that the vent hole is sealed by the mother metal of the lower or upper case or a filler metal melted by local heating at its outer periphery and hardened by cooling after brazing and cooling of the lower and upper cases.

In the foregoing fuel delivery pipes of the present invention, the hollow partition wall member positioned to form the air chamber in the internal space between the lower and upper cases is flexible in accordance with pressure pulsations of fuel caused by open-and-close operation of the fuel injection valves to fluctuate the capacity of the air chamber thereby to absorb the pressure pulsations of fuel and to reduce disorder of the injection amount of fuel. This is effective to improve the fuel-air ratio and to eliminate vibration of the fuel deliver pipe and unwanted noises. In the case that the cylindrical vent hole is formed by cutting or punching to be smaller in diameter than the thickness of the lower or upper case and that the mother metal of lower or upper case around the vent hole is locally melted by heating means and hardened by cooling to seal the vent hole after the component parts of the fuel delivery pipe were brazed, the vent hole can be sealed without any cap member used in a convention conventional fuel delivery pipe. This is useful to reduce the number of component parts and the manufacturing cost of the fuel delivery pipe.

In the case that a punch pointed at its tip is pushed into the bottom wall of the lower case or the peripheral wall of the upper case to form the vent hole in a burring hole shape, the vent hole can be formed without cutting chips and sealed by local heating of the mother metal of the lower or upper case even if the vent hole is formed larger in diameter than the thickness of the bottom wall or peripheral wall.

In the case that the hollow partition wall member is constructed of an elongate top wall, a peripheral wall downward from the whole periphery of the top wall and a lateral flange extended outward from the lower end of the peripheral wall, wherein the lateral flange of the partition wall member is fixed to a flat portion of the lower or upper case in a liquid-tight manner to form the air chamber, the hollow partition wall member forming the air chamber can be made of drawing of a sheet metal of thin thickness at a low cost.

In the case that the height of the peripheral wall of the partition wall member is formed larger than the width of the elongate top wall, opposed portions of the peripheral wall are flexible to fluctuate the capacity of the air chamber to absorb pressure pulsations of fuel in the internal space caused by open-and-close operation of the injection valves thereby to eliminate disorder of the injection amount of fuel.

In the case that at least one of the injection sockets is arranged at one-sided position in a width direction across the longitudinal direction of the bottom wall of the lower case and that the partition wall member is placed at an opposite-sided position in the width direction to occupy a greater part of the bottom wall of the lower case, the number of component parts can be reduced for decreasing the manufacturing cost, and the capacity of the air chamber can be enlarged to eliminate disorder of the injection amount of fuel.

In the case that the injection sockets each are comprised of a separately formed cylindrical body for connection with the respective injection valves and a cylindrical projection smaller in diameter than the cylindrical body and that the cylindrical projection is positioned in engagement with a mounting hole of the lower case such that the interior of the cylindrical body is in open communication with the internal space, the cylindrical projection of the injection socket can be fixed in place without any interference with the partition wall member to enlarge the air chamber for reducing disorder of the injection amount of fuel.

In the case that the hollow partition wall member is divided into a plurality of hollow partition wall members which are arranged among the injection sockets and brazed on the bottom wall of the lower case and that the bottom wall of the lower case is formed with a plurality of vent holes which are sealed after communicating each interior of the divided partition wall members with the atmosphere, the lower and upper cases can be formed approximately straight to facilitate the manufacture of the fuel delivery pipe.

DESCRIPTION OF PREFERRED EMBODIMENTS

Figure 1:
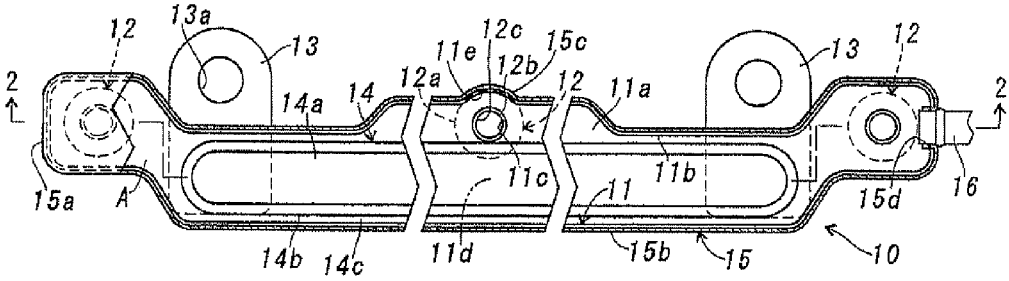
FIG. 1 is a sectional plan view of a fuel delivery pipe with damper function in a first embodiment of the present invention.

First of all, a first embodiment of a fuel delivery pipe with damper function in accordance with the present invention will be described with reference to FIGS. 1~4. The fuel delivery pipe 10 comprises an elongate lower case 11, three injection sockets 12 and two brackets 13 brazed to the bottom wall 11*a* of lower case 11, a hollow partition member 14 brazed to an inner surface of the bottom wall 11*a* in a liquid-tight manner, an elongate upper case 15 brazed to the lower case 11 to enclose the lower case in a liquid-tight manner, and a fuel supply pipe 16 brazed at its one end to the right end of upper case 15. The component parts 11~16 are made of steel and plated with nickel for anti-corrosion. The main body of fuel delivery pipe 10 composed of the lower and upper cases 11 and 15 brazed to each other in a liquid-tight manner is in a longitudinal configuration complicated in a plan view, and the whole length of the main body is 236.6 mm.

As shown in FIGS. 1~4, the elongate lower case 11 is in the form of a stamped sheet-metal formed with a flat bottom wall 11*a* and an upright flange 11*b* raised from the whole periphery of bottom wall 11*a*. As shown in FIG. 1, the plane configuration of lower case 11 is comprised of a laterally elongate main part forming the greater part of lower case 11, an upward portion projected from the central part of lower case 11 and upwardly crooked end portions extending from opposite ends of lower case 11. As shown in FIG. 1, the bottom wall 11*a* is formed at its upward projected portion and crooked end portions with equally spaced mounting holes 11*c* for positioning injection sockets 12 in place. The upward projected portion of lower case 11 is formed with an arcuate projection 11*e* concentric with the central mounting hole 11*c* for engagement with the injection socket 12. The bottom wall 11*a* is at its center with a cylindrical vent hole 11*d* smaller in diameter (for instance, 0.5 mm) than half the thickness of bottom wall 11*a* (for instance, 1.0 mm or 1.2 mm). (See two-dots chain line in a partly enlarged view of FIG. 3)

As shown in FIGS. 1~4, the injection sockets 12 each are in the form of a bottomed cylindrical body 12*a* integrally formed with a cylindrical portion 12*b* projected outward from the bottom of body 12*a*. The injection sockets 12 each are positioned in engagement with the mounting hole 11*c* at their cylindrical projection and brazed to the bottom surface of lower case 11 in a fluid-tight manner. The interior of each injection socket 12 is in open communication with an internal space A between the lower case 11 and upper case 15 through an opening 12*c* of the cylindrical projection 12*b*. Brackets 13 each formed with a mounting hole 13*a* are positioned in engagement with the bottom surface of lower case 22 and brazed in place.

As shown in FIGS. 1~4, the hollow partition wall member 14 is in the form of a stamped sheet metal comprised of an elongate top wall 14*a* rounded at its opposite ends, a peripheral wall 14*b* downward from the whole periphery of top wall 14*a*, and a radial flange 14*c* extended outward from the lower end of peripheral wall 14*b*. The thickness of partition wall member 14 is, for instance, 0.35 mm. The whole length and width of partition wall member 14 occupies a greater part of the elongate lower case 11. The partition wall member 14 is positioned in engagement with a flat portion of lower case 11 at its radial flange 14*c* and brazed in place in a liquid-tight manner to form an air chamber B with the lower case 11. The air chamber B is communicated with the atmosphere through the vent hole 11*d*.

Figure 2:
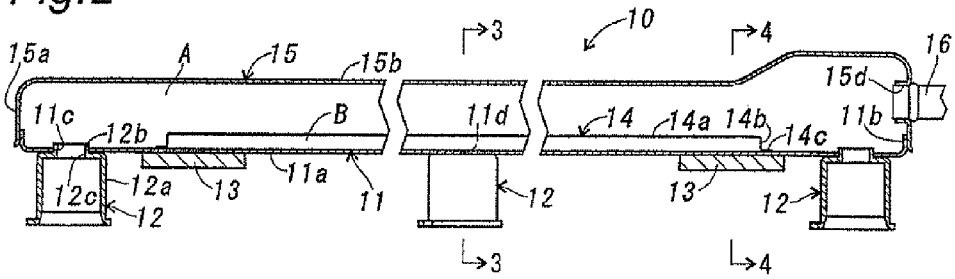
FIG. 2 is a sectional view of the fuel delivery pipe taken along line 2-2 in FIG. 1.
Figure 3:
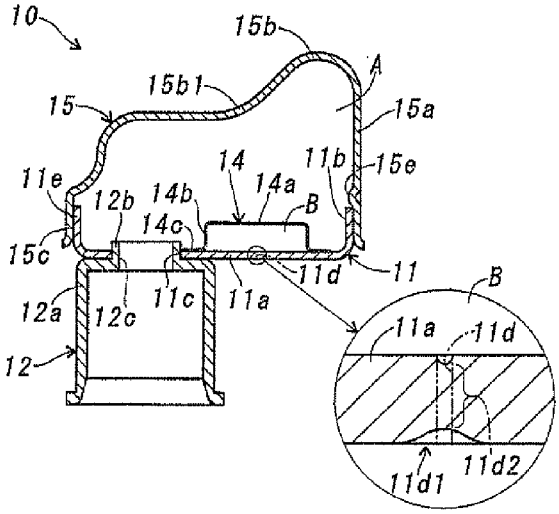
FIG. 3 is a cross-sectional view taken along line 3-3 in FIG. 2.
Figure 4:
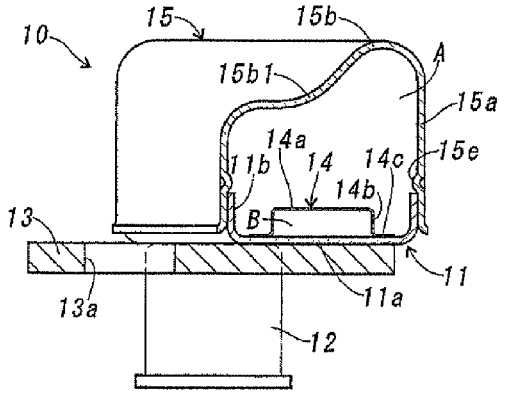
FIG. 4 is a cross-sectional view taken along line 4-4 in FIG. 2.
Figure 5:
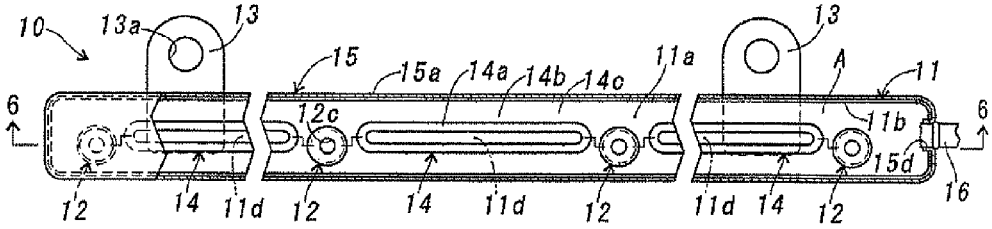
FIG. 5 is a sectional plan view of a fuel delivery pipe with damper function in a second embodiment of the present invention.
Figure 6:
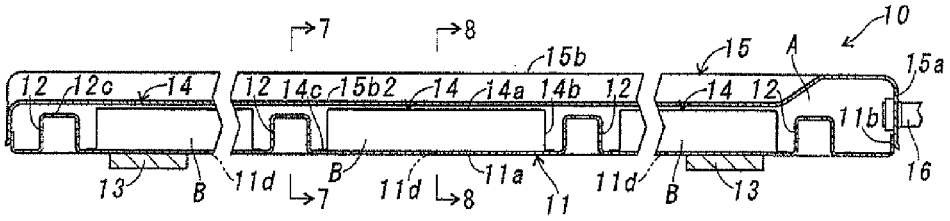
FIG. 6 is a sectional view of the fuel delivery pipe taken along line 6-6 in FIG. 5.

As shown in FIGS. 1~4, the elongate upper case 15 is in the form of a stamped sheet metal formed with a peripheral wall 15*a* coupled with the whole periphery of upright flange 11*b* of lower case 11 and a ceiling wall 15*b* enclosing the upper side of peripheral wall 15*a*. The peripheral wall 15*a* is formed with a plurality of circumferentially spaced inward projections 15*e* to be engaged with the upper edge of upright flange 11*b*. When coupled with the upright flange 11*b* of lower case 11, the peripheral wall 15*a* of upper case 15 is positioned by engagement with the upper edge of upright flange 11*b* at its inward projections 15*e* and brazed in place to the upright flange 11*b* to form an internal space A to be filled with fuel. The air chamber B is positioned in the internal space A but isolated from the internal space A by means of the partition wall member 14. In this embodiment, the cross-section of upper case 15 is arcuated at its whole corner and formed in a two-step trapezoid as shown in FIG. 3. In FIGS. 1 and 2, the right end portion of upper case 15 in the longitudinal direction is formed rectangular in cross-section as shown in FIG. 4 to enlarge the internal space thereof. The upper case 15 is formed at its right end with a flanged opening 15*d* by burring. One end of the fuel supply pipe 16 is inserted into the flanged opening 15*d* and brazed to the right end of upper case 15.

In the process of the fuel delivery pipe 10, the sockets 12, brackets 13 and partition wall member 14 are positioned on the lower case 11 and temporarily fixed in place by resistance welding (for instance, spot-welding or projection welding), and the peripheral wall 15*a* of upper case 15 is coupled with the upright flange 11*b* of lower case 11 and positioned at its inward projections by engagement with the upper end of upright flange 11*b* to enclose the whole upper side of lower case 11. Thereafter, the lower case 11 is turned to be placed upward in reverse, and the one end of fuel supply pipe 16 is inserted into the flanged opening 15*d* of upper case 15. In such a condition, a filler metal is placed at portions necessary for brazing the lower and upper cases 11 and 15 and the fuel supply pipe 16.

The component parts 11~16 assembled as described above are loaded in a furnace and heated for brazing. In this process, the component parts 11, 12, 14~16 are brazed in a liquid-tight manner, and the brackets 13 are brazed to the lower case 11. In this embodiment, copper is used as the filler metal. Although the air in chamber B is expanded by heating in the furnace, the vent hole 11*d* is useful to communicate the air chamber B with the atmosphere thereby to prevent deformation of the partition wall member 14 of thin thickness caused by increase of pressure in the air chamber B. This is effective to avoid the occurrence of difference in damper function of pressure pulsations of each fuel delivery pipe.

The brazed fuel delivery pipe 10 is taken out from the furnace and cooled at a normal temperature. Thereafter, a portion of lower case 11 around the outside end $\mathbf{11}d_1$ of vent hole 11*d* is locally heated and melted by laser-beam so that at least a portion $\mathbf{11}d_2$ of vent hole 11*d* is filled with melted mother metal of lower case 11 under the capillary action and that the vent hole is closed by cooling of the mother metal to complete a product of the fuel delivery pipe 10. During the manufacturing process, it is preferable that the fuel delivery pipe 10 and the heating device such as a laser device (at least the heating head of the device) are accommodated in a hermetic container filled with helium under approximately the same pressure as that of fuel filled in the internal space A. In such a process, the helium filled and pressurized in the internal space A is effective to decrease the stress to the partition wall member 14 caused by fuel pressure acting in the internal space A. This decreases the occurrence of damage of the partition wall member 14.

When the fuel pressure in the fuel delivery pipe 10 is fluctuated by open-and-close operation of the fuel injection valve, the top wall 14*a* of partition wall member 14 forming the largest area of the air chamber B in the internal space A is flexible to absorb the pressure pulsations of fuel thereby to decrease disorder of the injection amount of fuel. This is effective to improve the fuel-air ratio and to eliminate vibration of the fuel delivery pipe 10 and unwanted noises. In the manufacturing process described above, the cylindrical vent hole 11*d* is formed smaller in diameter than half the thickness of lower case 11, and the mother metal of lower case 11 around the vent hole 11*d* is locally melted by laser beam and cooled to close the vent hole 11*d* after the component parts of the fuel delivery pipe were brazed in a liquid-tight manner. Thus, the vent hole 11*d* can be sealed without any cap member used in a conventional fuel delivery pipe. This is useful to reduce the number of component parts and the manufacturing cost of the fuel delivery pipe.

In the fuel delivery pipe, each injection socket 12 is placed at a one-sided position in the width direction across the longitudinal direction of the bottom wall 11*a* of lower case 11, and the partition wall member 14 is placed at an opposite-sided position to each injection socket 12 in the width direction to occupy the greater part of bottom wall 11*a* of lower case 11 in the longitudinal direction. With such arrangement of each injection socket 12 and partition wall member 14, the capacity of air chamber B formed by the partition wall member 14 can be increased to reduce disorder in the injection amount of fuel. In this first embodiment, the injection socket 12 is assembled with the lower case 11 in such a manner that the cylindrical portion 12*b* smaller in diameter than the bottomed cylindrical body 12*a* separately formed from the lower case 11 is engaged with the mounting hole 11*c* of lower case 11. With such assembly of the injection socket 12, the tip of cylindrical portion 12*b* is projected into the interior of fuel delivery pipe 10 without any interference with the partition wall member 14 forming the air chamber B. Accordingly, the width of partition wall member 14 can be enlarged to increase the capacity of air chamber B thereby to further reduce disorder in the injection amount of fuel. Although in the first embodiment, all the three injection sockets 12 are aligned at the one-sided position, only the central injection socket 12 may be placed at the one-sided position while the other injection sockets 12 may be placed at an appropriate position.

In the fuel delivery pipe, the section of upper case 15 across the longitudinal direction is rounded at its whole corner and formed in a two stepped trapezoid. With such configuration of the cross-section of upper case 15, an inwardly curved portion 15$b_1$ formed along the longitudinal direction of upper case 15 displaces in a direction of its thickness in accordance with fluctuation of fuel pressure in the internal space A to absorb pressure pulsations of fuel in the internal space A. Since the pressure pulsations of fuel in the internal space A are absorbed by displacement of the curved portion 15$b_1$ in addition to suppression caused by fluctuation of the capacity of the air chamber B, disorder in the injection amount of fuel is further reduced. In a modification of the fuel delivery pipe, the ceiling wall 15*b* of upper case 15 may be flattened without curved portion 15$b_1$. In such a modification, the partition wall member 14 is brazed at its radial flange 14*c* to an inner surface of the flat ceiling wall in a liquid-tight manner to form the air chamber B, and the vent hole of small diameter is formed in the ceiling wall 15*b* for communication with the atmosphere and closed by the mother metal of upper case 15 locally melted by the laser beam as in the first embodiment.

Disclosed in FIGS. 5~8 is a second embodiment of a fuel delivery pipe in accordance with the present invention. The fuel delivery pipe 10 in the second embodiment is comprised of elongate lower and upper cases 11 and 15 brazed with each other in a liquid-tight manner. Four injection sockets 12 are integrally formed with the lower case 11. The hollow partition wall member 14 is divided into three pieces and arranged among the injection sockets 12 in a longitudinal direction.

In this second embodiment, the four injection sockets 12 each are in the form of a bottomed cylindrical body formed integrally formed with the bottom wall of lower case 11 by drawing and equally spaced in the longitudinal direction of lower case 11. The bottom wall of each injection socket 12 is formed with an opening 12*c* for communication with an internal space A. The divided hollow partition wall members 14 each are in the form of an elongate strip in cross-section. The height of periphery of each hollow partition wall member 14 is larger than the width across the longitudinal direction of top wall 14*a*. The divided hollow partition members 14 each are brazed to the bottom wall 11*a* of lower case 11 in a liquid-tight manner to form an air chamber B. The injection sockets 12 each are placed at a position slightly sided from the divided hollow partition wall members 14. The bottom wall 11*a* of lower case 11 is formed with three vent holes 11*d* at each position corresponding with the hollow partition wall members 14 for communication with the atmosphere.

Figure 7:
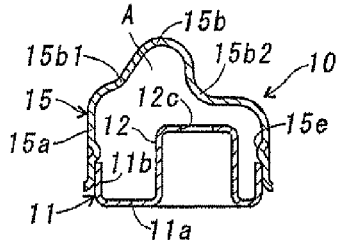
FIG. 7 is a cross-sectional view taken along line 7-7 in FIG. 6.
Figure 8:
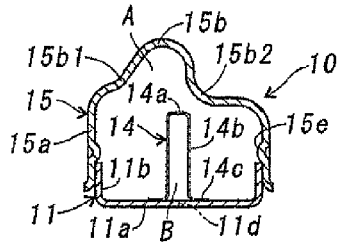
FIG. 8 is a cross-sectional view taken along line 8-8 in FIG. 6.

As shown in FIGS. 7 and 8, the cross-section of upper case 15 is asymmetrically formed in stepped width and height. The upper case 15 is rounded at its whole corner and formed rectangular in cross-section at its right end portion to enlarge the sectional area of internal space A. The other components of the fuel delivery pipe are substantially the same as those in the first embodiment.

In the fuel delivery pipe of the second embodiment, mainly the peripheral walls 14*b* of each hollow partition wall member 14 are flexible in accordance with fluctuation of fuel pressure in the internal space A. The flexible peripheral walls 14*b* are provided at opposite sides of each hollow partition wall member 14. As the area of the flexible peripheral walls 14*b* is increased more than that of the flexible top wall 14*a* of the single hollow partition wall member 14 in the first embodiment, the pressure pulsations of fuel in the internal space A are more effectively absorbed to reduce disorder of the injection amount of fuel for improvement of the air-fuel ratio and to eliminate vibration and unwanted noises. As the fuel delivery pipe is manufactured without any cap member used in a conventional fuel delivery pipe, the manufacturing cost can be reduced, and the appearance of the product can be enhanced.

As the upper case 15 is made approximately in a straight form to enclose the divided hollow partition wall members 14 and the injection sockets 12 arranged in the lateral width of each partition wall member 14, the manufacturing cost of the fuel delivery pipe can be reduced. The inwardly projected portions 15*b*1, 15*b*2 of upper case 15 in cross-section are displaced in the thickness direction of upper 15 in accordance with fluctuation of fuel pressure in the internal space A to more effectively absorb the pressure pulsations of fuel.

In the manufacturing process, the component parts 12, 13 and 14 are temporarily fixed by spot-welding in place on the lower case 11 and filler metals are preplaced on portions necessary for brazing. Thereafter, the upper case 15 is coupled at its peripheral wall 15*a* with the upright flange 11*b* of lower case 11 after insertion of the fuel supply pipe 16 and filler metals are preplaced on portions necessary for brazing. Thus, all the component parts 11~16 are brazed at the same time in the furnace. In a practical embodiment of the present invention, the component parts 12, 13 and 14 may be preliminarily brazed to the lower case 11, and thereafter, the upper case 15 may be coupled at its peripheral wall 15*a* with the upright flange 11*b* of lower case 11 and brazed to the lower case 11. In such a case, the brackets 13 and partition wall members 14 may be fixed in place by seam welding substituted for brazing.

Although in the manufacturing process described above, the vent hole 11*d* was sealed by the mother metal of lower case 11 locally melted by laser beam, the vent hole 11*d* may be sealed by a filler metal melted by laser beam, torch for TIG welding or other heating means.

Figure 9:
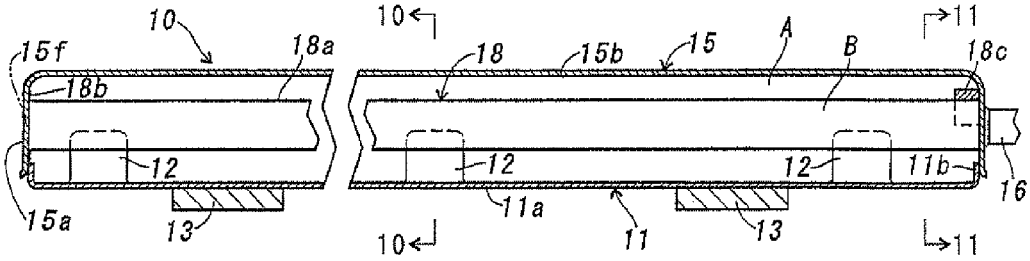
FIG. 9 is a sectional view of a fuel delivery pipe with damper function in a third embodiment of the present invention.
Figure 10:
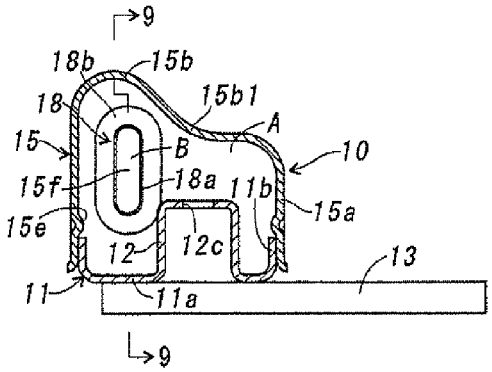
FIG. 10 is a cross-sectional view taken along line 10-10 in FIG. 9.
Figure 11:
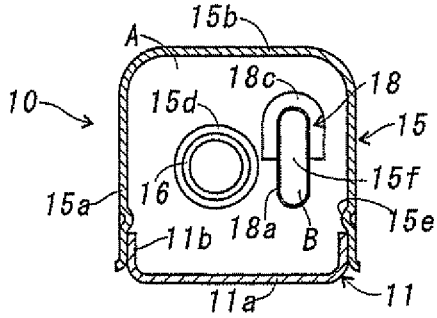
FIG. 11 is a cross-sectional view taken along line 11-11 in FIG. 9.

Illustrated in FIGS. 9~11 is a third embodiment of a fuel delivery pipe with damper function in accordance with the present invention. In this third embodiment, an elongate main body of the fuel delivery pipe 10 is comprised of lower and upper cases 11 and 15 brazed to each other in a liquid-tight manner as in the second embodiment. The cross-section of the main body is the same as that in the first embodiment. The component parts of the fuel delivery pipe 10 are substantially the same as those in the first embodiment, except for an elongate hollow partition wall member 18 of flattened cylindrical form in cross-section jointed at its opposite ends to the peripheral wall 15*a* of upper case 15 to form the air chamber B.

As shown in FIG. 10, the cylindrical portion of partition wall member 18 has flat side faces 18*a* opposed to one another. As shown in FIG. 9, the cylindrical portion of partition wall member 18 is formed at its left end with a radial flange 18*b*, and the upper case 15 is provided at its right end with a holder 18*c* of reversed U-letter form in cross-section for engagement with the flat side faces 18*a* of partition wall member 18. The holder 18*c* is brazed or welded to the inner surface of upper case 15. A vent hole 15*f* is formed in the left end of upper case 15 for communication with the interior of the cylindrical portion of partition wall member 18 in the same manner as in the foregoing embodiment.

Before the upper case 15 is brazed with the lower case 11, the partition wall member 18 is inserted in the upper case 15 in parallel therewith and engaged with the holder 18*c* at its right-side end and with the peripheral wall 15*a* of upper case 15 at its radial flange 18*b*. In such a condition, a filler metal is pre-placed on the portions to be brazed. Thereafter, the upper case 15 is coupled with the upright flange 11*b* of lower case 11*b* at its peripheral wall 15*a*, and the fuel supply pipe 16 is inserted into the upper case 15. Thus, the assembly of the component parts is brazed in the furnace in a condition where a filler metal was pre-placed on a portion of fuel supply pipe 16 to be brazed. With such a manufacturing process, the partition wall member 18 is brazed to the internal surface of the peripheral wall 15*a* of upper case 15 at its opposite ends, and the air chamber B formed in the partition wall member 15 is communicated with the atmosphere through the vent hole 15*f*. After the fuel delivery pipe 10 is taken out of the brazing furnace and cooled, the vent hole 15*f* is closed by the mother metal of upper case 15 locally melted by laser beam and hardened by cooling. During the manufacturing process, it is preferable that the fuel delivery pipe 10 and the heating device such as a laser device are accommodated in a hermetic container filled with helium under approximately the same pressure as that of fuel filled in the internal space.

Figure 12:
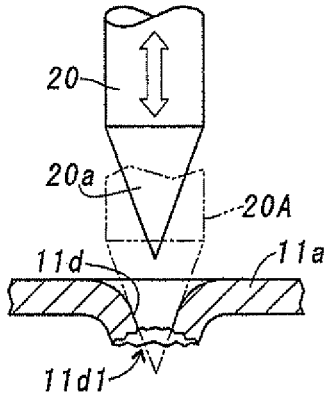
FIG. 12 is illustration of a forming method of a vent hole in a modification of the present invention.

Although in the foregoing embodiments, the vent hole 11*d* was formed by cutting, a punch 20 pointed at its tip 20*a* may be used to form the vent hole 11*d* as shown in FIG. 12. In this process, the punch 20 is pushed into the bottom wall 11*a* of lower case 11 or the peripheral wall 15*a* of upper case from its inside so that the vent hole 11*d* is formed in a burring hole shape. With such a punching method, the vent hole 11*d* can be formed without cutting chips and closed by local melting of the mother metal of bottom wall 11*a* or peripheral wall 15*a* even if the vent hole is formed lager in diameter than the thickness of the bottom wall 11*a* or peripheral wall 15*a*.

What is claimed is:

1. A fuel delivery pipe with damper function, comprising:

an elongate lower case provided at its bottom with a plurality of injection sockets for connection with fuel injection valves to be opened and closed under control of a controller unit;

an upper case coupled with the lower case in a liquid-tight manner to form an internal space to be filled with fuel under pressure supplied from a fuel pump;

a hollow partition wall member the whole periphery of which is brazed to an inner surface of the bottom wall of the lower case to form an air chamber isolated from the internal space, the partition wall member being flexible in accordance with pressure pulsations of fuel in the internal space caused by open-and-close operation of the injection valves; and a vent hole formed in the bottom wall of the lower case and sealed after communicating the air chamber with the atmosphere therethrough;

wherein the injection sockets are placed at a one-sided position in a width direction across the longitudinal direction of the bottom wall of the lower case, while the partition wall member is placed at an opposite-sided position in the width direction to occupy a greater part of the bottom wall of the lower case; and wherein the vent hole is formed smaller in diameter than the thickness of the lower case and sealed by the mother metal of the lower case or a filler metal melted by local heating at its outer periphery and hardened by cooling after brazing process of the coupled lower and upper cases.

2. A fuel delivery pipe as claimed in claim 1, wherein the vent hole is in the form of a burring hole formed by pushing a punch pointed at its tip into the bottom wall of the lower case.

3. A fuel delivery pipe as claimed in claim 1, wherein the hollow partition wall member is constructed of an elongate top wall, a peripheral wall downward from the whole periphery of the top wall and a lateral flange extended outward from the lower end of the peripheral wall, and wherein the lateral flange of the partition wall member is brazed to a flat portion of the bottom wall of the lower case in a liquid-tight manner to form the air chamber.

4. A fuel delivery pipe with damper function comprising:

an elongated lower case provided at its bottom with a plurality of injection sockets for connection with fuel injection valves to be opened and closed under control of a control unit;

an upper case coupled with the lower case in a liquid-tight manner to form an internal space to be tilled with fuel under pressure supplied from a fuel pump;

a plurality of hollow partition wall members arranged among the injection sockets and brazed on the bottom wall of the lower case to form therein an air chamber isolated from the internal space; and a plurality of vent holes formed in the bottom wall of the lower case and sealed after communicating each air chamber in the partition wall members with the atmosphere, wherein the vent holes each are formed smaller in diameter than the thickness of the bottom wall of the lower case and sealed by the mother metal of the lower case or a filler metal melted by local heating at their outer peripheries and hardened by cooling after brazing process of the coupled lower and upper cases.

5. A fuel delivery pipe as claimed in claim 1, wherein the upper case is formed with an inwardly bent portion along a longitudinal direction that is displaced in its thickness direction to fluctuate the capacity of the internal space in accordance with pressure pulsations of fuel caused by open-and-close operation of the injection valves thereby to absorb the pressure pulsations of fuel and to reduce disorder of the injection amount of fuel.

6. A fuel delivery pipe as claimed in claim 4, wherein the height of the peripheral wall of the partition wall member is formed larger than the width of a top wall of the partition wall member so that opposed portions of the peripheral wall are flexible to fluctuate the capacity of the air chamber thereby to absorb pressure pulsations of fuel in the internal space.

* * * * *